United States Patent [19]

Head et al.

[11] Patent Number: 4,880,211

[45] Date of Patent: Nov. 14, 1989

[54] METHOD AND APPARATUS FOR RELINING A REFRACTORY LINED VESSEL

[76] Inventors: James D. Head, 207 Highland Dr.; Edward F. Burns, 207 Leeds Dr.; William A. Schleizer, 4 Division Rd., all of Valparaiso, Ind. 46383; C. Douglas White, 2401 Riverview Dr., Chesterton, Ind. 46304; Dennis L. Gentry, 9216 W. 143rd Pl., Cedar Lake, Ind. 46303

[21] Appl. No.: 286,889

[22] Filed: Dec. 20, 1988

Related U.S. Application Data

[63] Continuation-in-part of Ser. No. 924,405, Oct. 29, 1986, Pat. No. 4,793,595.

[51] Int. Cl.[4] ..... C21B 13/00; C21B 15/00

[52] U.S. Cl. ..... 266/44; 266/281

[58] Field of Search ..... 266/44, 281

[56] References Cited

U.S. PATENT DOCUMENTS

| | | | |
|---|---|---|---|
| 2,476,305 | 7/1949 | Kimmel | 25/155.5 |
| 2,851,760 | 9/1958 | Taylor | 25/155.5 |
| 3,148,230 | 8/1964 | Behner | 264/30 |
| 3,610,183 | 10/1971 | Kolboy et al. | 110/182 |
| 3,880,967 | 4/1975 | Loggins et al. | 264/30 |
| 3.963,815 | 6/1976 | Ezaki et al. | 264/30 |
| 4,077,848 | 3/1978 | Gainer et al. | 201/41 |
| 4,106,760 | 8/1978 | Kono | 266/281 |
| 4,127,626 | 11/1978 | Kubo et al. | 264/30 |
| 4,143,104 | 3/1979 | van Konijnenburg et al. | 264/30 |
| 4,189,457 | 2/1980 | Clement, Jr. | 264/30 |
| 4,222,522 | 9/1980 | Kubo et al. | 239/160 |
| 4,253,646 | 3/1981 | Goto | 266/281 |
| 4,272,020 | 6/1981 | Allison | 239/8 |
| 4,301,998 | 11/1981 | Rodway | 266/281 |
| 4,313,565 | 2/1982 | Focant | 239/132 |
| 4,364,798 | 12/1982 | Costa | 202/267 |
| 4,494,737 | 1/1985 | Rymarchyk, Jr. et al. | 266/281 |
| 4,534,730 | 8/1985 | Kraus | 432/3 |
| 4,577,385 | 3/1986 | Omae et al. | 29/402 |
| 4,607,994 | 8/1986 | Jacobsson | 266/281 |

*Primary Examiner*—Peter D. Rosenberg

*Attorney, Agent, or Firm*—Stanley J. Price, Jr.

[57] ABSTRACT

Method and apparatus to spray the interior surface of a refractory lined vessel that receives molten metal where the interior refractory surface of the vessel is most prone to erode. Supply pipes are introduced into the vessel and are pivotally supported on an upper portion of the vessel to pivot about angularly related axis, such as horizontal and vertical axis. Said pipes are pivoted around at least one of said axis while water is propelled through said elongated pipe to a corroded portion of said interior surface to remove scale from and clean said corroded surface. Air entrained granulated refractory material, preferably mixed with water to form a slurry, is propelled through said pipe to coat the clean interior surface. A movable end portion is hingedly connected to said elongated pipe to provide for the angular control of said movable end portion. When said elongated pipe is in an elevated position, said movable end portion can be positioned so that it is at a substantially perpendicular portion relative to the wall to increase the impact of the propelled material onto said wall. The two process operation is repeated for at different locations around the periphery of the vessel to clean and reline the entire wall portion, if required. Alternatively, all eroded portions may be cleaned in turn followed by relining each portion.

11 Claims, 2 Drawing Sheets

METHOD AND APPARATUS FOR RELINING A REFRACTORY LINED VESSEL

CROSS-REFERENCE TO RELATED APPLICATION

This application is a continuation in part of co-pending prior application, Ser. No. 924,405, filed Oct. 29, 1986 and entitled "Method And Apparatus For Relining Blast Furnace".

BACKGROUND OF THE INVENTION

1. Field of the Invention

This invention relates to a method and apparatus for spraying the interior surface of a cup-shaped type of vessel for receiving molten metal having a refractory lining that is exposed to elevated temperatures over a long period of use that results in deterioration of the interior refractory lining of said vessel. This invention also relates to an apparatus for spraying said interior refractory linings of said vessel. It particularly relates to a nozzle assembly supported on the sill or top edge of the vessel or in one of a plurality of windows that are circumferentially spaced and that extend through the side wall of a refractory wall. Particularly, the present invention relates to an operation combining two spraying methods, the first spraying method using materials that are sprayed onto an interior surface portion that requires removal of scale. The second spraying method is used to apply a new refractory coating onto the cleaned surface of the wall of the refractory body.

2. Description of the Prior Art

Refractory lined bodies used in the iron and steel industry for carrying, holding and pouring molten metal are normally exposed to elevated temperature over a long period of use. The interior refractory surfaces of these refractory bodies deteriorate with such extended use. Therefore, it is necessary to either replace or repair any deteriorated interior surface.

Initially, an interior surface was repaired by laying refractory brick over the deteriorated surface. However, the labor cost of brick laying was so exorbitant that the refractory industry has developed high temperature plastic refractories having a pliable construction to permit shaping of the material to the contour of the interior surface being relined. The preshaped plastic refractory material is installed by pneumatic hammers to mold the refractory lining to the contour of the interior surface. It is also known to utilize a heat resistant castable ceramic refractory that is installed on the interior surface in a manner similar to the installation of a conventional castable cement. This requires considerable labor and the erection of frames to contain the castable refractory cement until the latter is cured.

More recently, the deteriorated refractory surface of a blast furnace or the like has been reconditioned and repaired by the gunning application of a refractory material that is formed by mixing a dry mix of refractory binder and aggregate propelled through a hose by a stream of compressed air to a nozzle into which a wetting agent, such as water, is supplied to mix with the dry refractory to form a mix. This mix is sprayed onto the interior surface.

Typical gunning apparatus of the prior art includes U.S. Pat. Nos. 4,253,646 to Goto et al; 4,272,020 to Allison; 4,301,998 to Rodway and 4,494,737 to Rymarchyk, Jr. et al. These patents show a feed pipe for feeding the slurry in a gunning assembly in the direction of the axis of the refractory body whose interior surface is to be sprayed. It is necessary to change the direction of movement of the sprayed slurry so that the path of the movement of the slurry is turned in a direction oblique to the axis of the supply pipe when the slurry reaches its interior end portion through nozzles that extend angularly from the pipe interior end portion to direct the slurry against the interior surface to be sprayed.

Other typical gunning apparatus, such as depicted in U.S. Pat. Nos. 4,106,760 to Kono et al; 4,222,522 to Kubo et al; and 4,313,565 to Focant, pivotally support a slurry supply pipe on a movable car that supports the axis of pivoting of the slurry and must of necessity be a relatively massive counter-weighted car in order to maintain its balance for orientation.

It is also known to form an interior refractory wall within a refractory lined vessel by establishing a form within the vessel and providing a vibrating hopper above the vessel that feeds particulate refractory materials to the space between the form and the interior wall of the vessel shell and the material deposited in said space is compacted by tamping to form a solid cover of refractory material for the interior vessel wall. A typical device of the latter type is disclosed in U.S. Pat. No. 4,534,730 to Kraus. A drawback of this material is the tendency of the particulate refractory material to form a dust and the expensive equipment required for avoiding the formation of the dust and the expensive labor cost for removing the form after the refractory wall has been completed.

It is known in the prior art to dry newly lined refractory hearths and walls of vessels by use of directional devices. These directional devices direct the drying material in a predetermined direction into the vessel. A typical device of this type is disclosed in U.S. Pat. No. 3,610,183 to Kolboy et al. A drawback of this apparatus is that the directional devices are not movable once inserted and cannot be used for a relatively small portion of the vessel.

The methods of applying the material to be sprayed in the form of a liquid or slurry is superior to any method involving compacting a pulverulent material because of the health problems inherent in the formation of dust. However, in the application of liquid or slurry of materials through an elongated pipe, the force by which the liquid or slurry may be imparted is limited when the liquid or slurry is propelled through a delivery pipe - nozzle system that is not straight throughout its entire length. Therefore, it is necessary to provide a higher pressure imparting means to cause the liquid or slurry to be applied at a much higher pressure to overcome the loss of force that occurs when the liquid or slurry is caused to turn at an angle to the initial direction of its propulsion.

It is also beneficial to maintain the temperature of a refractory lined vessel within the operating temperature range to minimize the power loss needed for removing unwanted scale and applying a new coating of refractory material that bonds to the cleaned interior surface of a refractory lined vessel, such as a blast furnace, particularly when the refractory lined vessel operates at an extremely high temperature range. The use of concentric pipes in groups within a high temperature atmosphere is detrimental to the continued operation of the spray apparatus that is used to clean or reline an interior surface of such a refractory body in a high temperature environment.

SUMMARY OF THE INVENTION

The present invention provides a method and apparatus for relining a refractory lined vessel for receiving molten metal. The apparatus, when used with a closed vessel, is inserted in one of a plurality of circumferentially spaced windows extending around the periphery of the vessel or, in an open top vessel, is inserted on a pedestal on the top portion of said vessel. The pedestal is mounted on the sill of each window or on the top portion of said vessel and a swivel end bracket is pivotally supported about a vertical axis relative to the pedestal. The bracket is provided with a pair of vertical side walls that support horizontal pivot means. An elongated angle iron is constructed and arranged to have its outer end portion pivoted about the horizontal pivot means.

The elongated angle iron supports an elongated pipe so that the elongated pipe has its outer end portion extending outside the window and its inner end extending towards a portion of the interior surface of the blast furnace opposite the window through which the elongated pipe and its supporting elongated angle iron extends. A means is included to provide an air entrained granular refractory material to the outer end of the pipe and an independent supply means is connected to a pressurized water supply source to provide water to the elongated pipe. At its inner end, the pipe has an optional pipe extension or reducer of smaller diameter than that of the main portion of the pipe to insure more rapid flow of water when water is propelled through the pipe.

The interior end of the pipe is suspended from a hook at the end of a steel cable that extends over an overhead bracket support to the exterior of the refractory lined vessel around a pulley from a winch. The latter rotates in alternating rotational directions to control the length of steel cable that extends therefrom so it controls the vertical position of the vertically reciprocating inner end of the pipe used to supply either water or slurry to be applied or sprayed against the interior wall of the refractory lined vessel opposite the position through which the supply pipe extends. Means are provided for pivoting the swivel end bracket relative to the pedestal to cause a to and from movement of the elongated supply pipe, so as to enable the material to be sprayed from the pipe onto a portion of the interior wall that needs spraying. With the arrangement just described, the pipe is caused to pivot simultaneously about two angularly related axes normal to the length of the pipe.

In a particularly effective operation, two spraying methods are applied in sequence. In the first spraying method, water is propelled under pressure sufficient to enable the supply of water to impinge on the interior surface of the refractory lined vessel that has been eroded with scale so as to remove the scale from the portion of the interior surface. During the propulsion of the water, the pipe is swiveled in a horizontal direction while a winch lifts and lowers the inner end of the pipe to enable the water applied under pressure to impinge over a portion of the interior surface of the wall of the refractory lined vessel that has been eroded.

In the second method of the multiple spraying operation, air entrained refractory material of a pulverulent or granular nature is imparted, preferably as a slurry against the interior surface which has been previously cleaned by the first method involving the spraying of water. Other additional abrasive materials should be considered such as pecan shells, corn cobs, rice etc. to further prepare the surface. The operation may be performed at each of the circumferentially spaced windows so that each portion that is first cleaned and then coated by the sequence of methods may be accomplished followed by a sequence of methods at each successive window to enable an entire circumference of the interior surface of said refractory lined vessel to be treated. As an alternative, the water may be applied sequentially through each of the windows to remove scale, and, when the entire circumference has been cleaned, a coating of refractory material formed by spraying a slurry onto the clean interior surface may be applied step-by-step in sequence from each window in succession. It has been determined that four windows, each capable of spraying a quadrant of the circumference of the refractory lined vessel interior surface is preferred, because this arrangement provides sufficient coverage completely around the circumference of the interior surface. In one type of refractory lined vessel, the vertical dimension of the portion needing a new refractory coating by application of the slurry typically extends from approximately 15 feet below the level of the windows to approximately 15 feet above the level of the windows.

Some of the features of the present invention include supporting the supply pipe on a pedestal mounted at the sill of each window or at the top portion through which the supply pipe extends into the interior of the refractory lined vessel towards the portion of the interior surface which is to be sprayed. Such pedestal support at the vessel opening combines with the support provided by the steel or stainless steel cable depending upon temperatures, whose length is controlled by a winch exterior to the refractory lined vessel and the sliding support of the supply pipe supporting brackets relative to the pedestal on the window sill. Access from outside the vessel to said brackets permits relatively easy maintenance of the bearing surfaces relative to which the movement of the supply pipes is made. In addition, the use of a supply pipe that is straight throughout its length reduces the need for large pressure sources to propel the material sprayed at a given speed, or, in the alternative, assures the propulsion of the material sprayed at a maximum speed possible with the pressurized source available for propelling said spraying materials.

In another embodiment of the invention, the supply pipe enters the refractory lined vessel and is connected to it as previously described. The supply pipe has a rigid first portion and a movable nose portion at its end. The nose portion is connected to the rigid portion by a nose tilt hinge with nose draw springs. There is a flexible segment between the nose portion and the rigid portion which allows for the nose portion to be raised or lowered relative to the rigid portion. A clamp connects a nose draw bar to the nose portion. A cable, which is guided by pulleys, extends from the nose draw bar to the pedestal mounted at the sill of each window. A shell mounting clamp mounts a nose tilt control winch to a boom swivel bracket which is affixed to the pedestal.

In this embodiment of the invention, the nose end of the pipe can be raised or lowered and moved angularly relative to the rigid portion of the pipe so that a greater area of the refractory lined vessel can be relined from a single position. Another advantage of this embodiment is the ability to control the angle of the movable nose end so that when the elongated supply pipe is in an elevated position, the movable nose end can be moved upwardly or downwardly to improve the impact of the refractory material on the refractory lined vessel wall.

The aforesaid and additional benefits of the present invention will be better understood in the light of the description of the preferred embodiments of this invention that follows.

DESCRIPTION OF THE DRAWINGS

In the drawings that form part of a description of the preferred embodiments of this invention.

DESCRIPTION OF THE PREFERRED EMBODIMENTS

Figure 1:
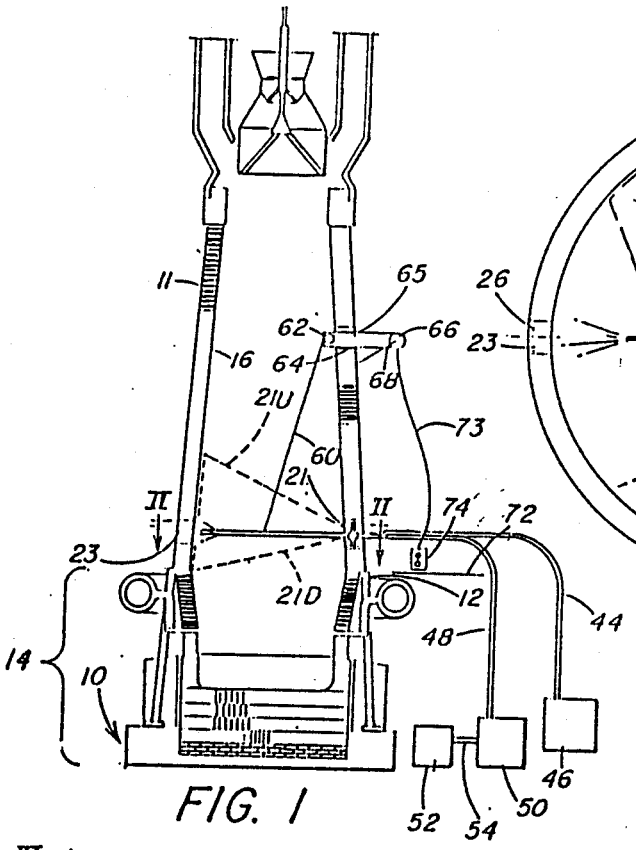
FIG. 1 is a vertical section of a blast furnace modified in accordance with one embodiment of the present invention.
Figure 2:
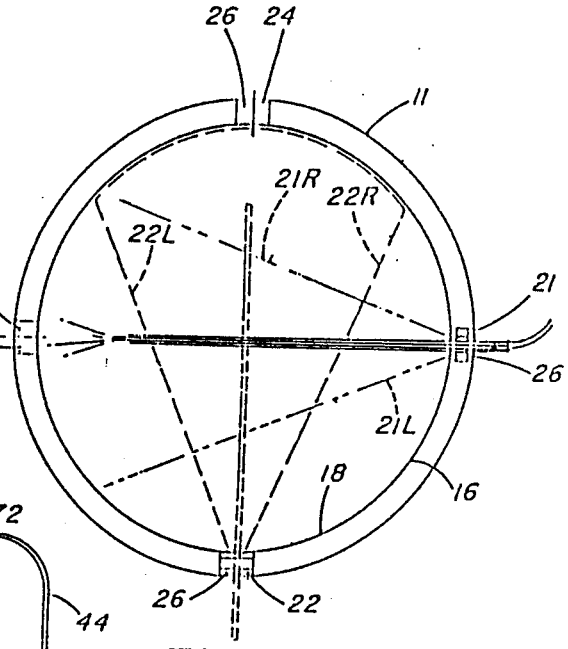
FIG. 2 is a horizontal cross-section taken along the line II—II of FIG. 1.

Referring to the drawings, a blast furnace 10 is shown having a construction that includes a generally truncated conical-shaped furnace wall 11 that extends vertically obliquely upward from a mantle 12 at the base of the wall. The portion of the furnace below mantle 12 comprises a conventional bosh, hearth and other conventional blast furnace elements which are not modified by the present invention and need not be described in this description.

Furnace 10 has an inner shell 16 formed of abutting steel plates. The interior surface 18 of the shell is susceptible to corrosion when the furnace is in operation over a long period of time. According to a preferred embodiment of the present invention, circumferentially spaced windows 21, 22, 23, and 24 are provided to extend through the furnace wall 11. The windows have sills 26 located approximately ten (10) feet above the mantle 12. Each sill 26 supports a pedestal 28. A swivel end bracket 30 is pivotally supported on each pedestal 28 by a vertical pivot bearing 32 at approximately the geometric center of the pedestal so as to enable the swivel end brackets to swivel relative to the pedestal about an angle of at least 45 degrees to each side of the diameter of a horizontal circle formed at the horizontal plane across the blast furnace that intersects sill 26.

Each bracket 30 is provided with a pair of vertical side walls 34. Each of the latter is grooved in its upper portion to provide a groove type bearing support 36.

An elongated angle iron 38 having oppositely extending stub rods 39 is inserted through the window 21 and into the furnace until stub rods 39 fit into the groove-type bearing supports 36 of the bracket 30. The elongated angle iron 38 supports an elongated pipe 40 throughout its entire length. The elongated angle iron 38 is provided with longitudinally spaced rings 41 through which pipe 40 extends to keep the pipe aligned with the elongated angle iron.

When installed for operation, the elongated pipe 40 extends from its outer end a short distance outside one of the windows 21 to 24 of blast furnace 10 to its inner end facing interior surface 18 of shell 16 of furnace wall 11 diametrically opposite the window within which the pipe is inserted. A coupling 42 communicates with the outer end of pipe 40. A water supply line 44 valved at 45 supplies water under pressure into the outer end of elongated pipe 40 from a pressurized water supply source 46. In addition, a granular refractory supply line 48 extending from a granular refractory source 50 to coupling 42 is also provided. Furthermore, a pressurized air source 52 communicates with the granular refractory source 50 through an air supply line 54. In addition, a supply line (not shown) is connected to a granular refractory source 50 for predampening granular refractory material.

The elongated pipe 40 may be supplied with an optional pipe extension or reducer 56 that tapers in interior diameter toward the inner end of pipe 40. In a preferred embodiment of this invention, the elongated pipe 40 is made of aluminum pipe $1\frac{1}{2}$ inches in diameter cradled in an elongated angle iron 38 having flanges 3 inches wide. The pipe extension 56 reduces the diameter of the pipe from the $1\frac{1}{2}$ inch diameter throughout the length of the pipe to approximately $\frac{3}{4}$ to 1 inch diameter. The purpose of the optional pipe extension or reducer 56 is to enhance the rate of flow of materials supplied through the elongated pipe.

An open-ended polygonal hook 58 suspended from the lower end of a steel cable 60 is supported by a bracket support 62 which in turn is secured to a winch support 64 mounted on the shell 16. The steel cable extends through an opening 65 in the furnace wall 11 approximately 16 feet above the level of sills 26 to a winch 66 supported externally of the furnace 10 by a winch support 68. Remote winch cable 73 extends downward from winch 66 to remote controls 74 which is carried at a support level 72 at which operators may stand to peer through the windows 21 to 24.

Winch 66 operates reversibly to extend and retract steel cable 60 to cause elongated pipe 40 to move vertically with hook 58 between an upper limit 21 U and on a lower limit 21 D. Also, means is provided to reciprocate the bracket 30 relative to the vertical pivot bearing 32 carried on pedestal 28 to pivot the elongated pipe 40 over an angle of at approximately 90 degrees or slightly more to enable the inner end of elongated pipe 40 to scan a quadrant of the interior surface 18, the center of which is defined by a vertical plane passing through the diameter of the horizontal cross-section of the blast furnace at the level of sills 26.

The apparatus just described is used whenever an inspection of a blast furnace shows that a part of the interior wall has become eroded. The portion of the interior wall most likely to be eroded is a band extending circumferentially of the interior surface from a lower level about 5 feet above the mantle 12 to an upper level approximately 20 feet above the mantle. Therefore, the location of the sills 26 at approximately 10 feet above the level of the mantle is most suitable to practice the present invention.

Whenever a portion of the interior surface of a blast furnace becomes eroded and begins to scale, it is necessary to first remove the scale and then apply a new refractory coating to the area that has been cleaned of the scale. The preferred thickness of the refractory material to be applied to the interior surface 18 is preferably in the range between 18 and 22 inches.

In using the apparatus just described, the elongated angle iron 38 with the elongated pipe 40 inserted through the longitudinally spaced rings 41 is surrounded by the polygonal shaped, open-ended hook 58 that is applied around the inner portion of the angle iron 38. The winch 66 has been rotated in a direction to lower the steel cable 60 with its open ended polygonal hook 58 extending from the bottom thereof. A short hook is used to grab the open-ended polygonal hook 58 to bring the open-ended polygonal hook 58 in surrounding relation to the elongated angle iron 38 and its supported elongated pipe 40 is threaded through longitudinally spaced rings 41. The pipe 40 extends beyond the interior end of the elongated angle iron 38 and the exterior end of the elongated pipe 40 extends beyond the end of the elongated angle iron 38. Pedestal 28 is also provided with a pair of rollers (not shown) to facilitate rolling movements of the elongated angle iron 38 from a position exterior of the blast furnace to a position within the furnace. The winch 66 is adjusted to permit the length of the steel cable 60 to be adjusted as the angle iron 38 and its supporting elongated pipe 40 is inserted into the interior of the blast furnace 10 through one of the circumferentially spaced windows 21, 22, 23, or 24.

If the spraying method involves the application of water under high pressure to remove scale as in the first method of a two method operation, it is advisable to attach the optional pipe extension or reducer 56 to the front of the elongated pipe 40 that forms the interior end of the pipe before the pipe and its supporting angle iron 38 are inserted into the blast furnace. The pipe 40 supported on angle iron 38 is inserted through the window 21 into the interior of the refractory body or blast furnace 10 with the interior end of the elongated pipe 40 facing a part of the portion of the interior surface 18 diametrically opposite window 21 and an exterior portion of the pipe extending outside of the refractory body. The elongated angle iron 38 arrives at an axial position such that the stub rods 39 are received in the groove type bearing supports 36 of bracket 30 so as to pivotally support the pipe for pivoting relative to the sill 26 of window 21 in a vertical plane about a horizontal pivot axis defined by stub rods 39. Also, pipe 40 can pivot about a vertical axis defined by vertical pivot 32 in a horizontal direction on both sides of a vertical plane intersecting the diameter of the horizontal cross-section of the blast furnace 10 at the level of sills 26 to a maximum angle of at least 45 degrees to each side of said vertical plane. While the two axes of pivoting are orthogonal to each other and to the length of pipe 40, it is understood that the axes of pivoting may be oblique to one another without departing from the spirit of this invention. The winch 66 is simultaneously controlled to lift and lower the inner end of elongated angle iron 38 and its supported elongated pipe 40 so that the inner end of the elongated pipe 40 faces a portion of the interior wall 18 of the blast furnace 10 that extends between a lower limit elevation that is 15 feet below the sills 26 at its lower end as defined by line 21D in FIG. 1 and an upper limit as defined at a line of intersection on the interior surface 18 intercepted by line 21U which is approximately 15 feet above the horizontal plane of the sills 26.

In the first spraying method performed in a two method operation, water is supplied under pressure through water supply line 44 from pressurized water supply source 46 through coupling 42 communicating with the outer end of pipe 40 and through the entire length of the elongated supply pipe 40 and its optional pipe extension or reducer 56 to enable the water to be propelled at a speed sufficient to impinge on the interior surface 18 with force sufficient to remove the scale from the impinged portion of the interior surface. When the entire area requiring removal of scale has been cleaned, the pipe 40 and its supporting angle iron 38 are removed from the interior of the furnace, through window 21, the optional pipe extension or reducer 56 is dismantled from the front of pipe 40, the elongated angle iron 38 and its supported elongated pipe is again introduced through window 21 into the interior of the blast furnace to assume the position they occupied for the scale removal process to perform a second spraying method of a two method operation that constitutes a preferred embodiment of this invention. A pulverulent can be used to enhance cleaning process.

The coupling 42 receives pressurized water from the pressurized water supply source 46 through the water supply line 44 as well as air entrained granular refractory materials through the granular refractory supply line 48 which supplies the granular refractory from granular refractory source 50. To accelerate the application of the granular refractory materials from source 50, pressurized air from pressurized air source 52 is supplied through supply line 54 into the granular refractory source 50 to help propel the granular refractory materials through the granular refractory supply line 48. The pressurized water mixes with the air entrained granular refractory material at the coupling 42 and is imparted through the length of the supply pipe 40. Simultaneously, the latter is moved in a reciprocating manner with a horizontal component of motion about the vertical pivot point 32 and is also reciprocated vertically about a horizontal axis defined by stub rods 39 through the simultaneous raising and lowering of the hook 58 at the bottom end of steel cable 60 in response to the periodical reversal of the rotation of winch 66 so as to cause the inner end of supply pipe 40 to supply a slurry containing water mixed with the granular refractory material to be applied against the quadrant of interior surface 18 that is opposite window 21. The application of the slurry continues until a coating of a refractory material of desired thickness, preferably 18 to 22 inches thick, is applied onto the clean interior surface 18 from which scale has been removed by the first method.

The operation performing the first method and the second method consecutively can then be performed at window 22 followed by performing the operation at window 23 and then at window 24 until all of the eroded portions of the interior surface 18 have been cleaned of scale and the cleaned surface portions coated with a suitable thickness of refractory material. During this operation, it is not necessary to cool the blast furnace. Therefore, the furnace can continue to burn when the scale is removed and replaced by the refractory slurry applied to the interior surface 18.

As an alternative to the aforesaid process, it is possible to perform the first method at each of the four windows in turn and then, after the entire band 30 feet high of interior surface 18 has been cleaned by removing all scale therefrom, the coating with a refractory slurry can be accomplished from each of the four windows in sequence. In the latter case, it is only necessary to remove the optional pipe extension 56 from the front of the supply pipe 40 after the multiple step cleaning method has been completed and the blast furnace is ready for the application of additional coating of refractory material. However, it is understood that only four steps of removing and replacing the optional pipe extension or reducer 56 is needed if the cleaning method is performed alternately with the method of applying the replacement refractory coating at each individual window.

Figure 5:
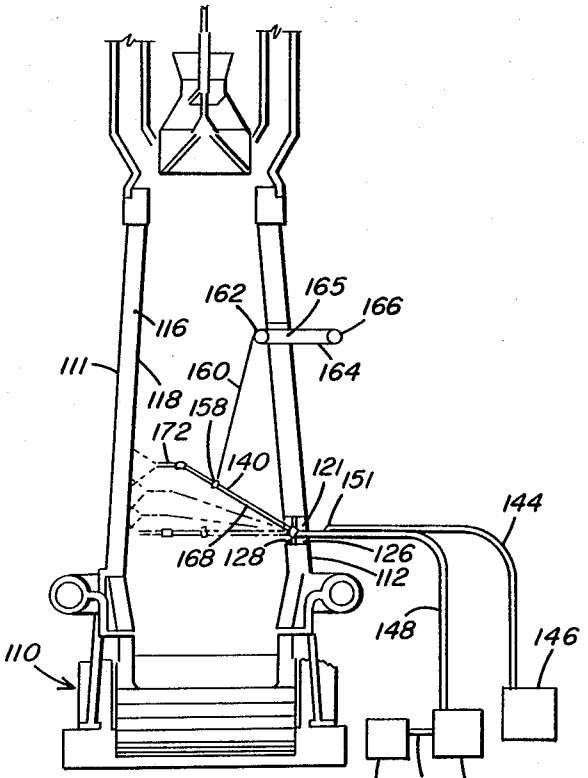
FIG. 5 is a vertical section of a blast furnace modified in accordance with a second embodiment of the present invention.

FIGS. 5–8 show another embodiment of the invention. A blast furnace 110 is shown in FIG. 5 as having a construction that includes a generally truncated conical-shaped furnace wall 111 that extends vertically obliquely upward from a mantle 112 as the base of the wall. The portion of the furnace below mantle 112 comprising a conventional bosh, hearth and other conventional blast furnace elements which are not modified by this embodiment of the present invention and need not be described in the description.

Figure 8:
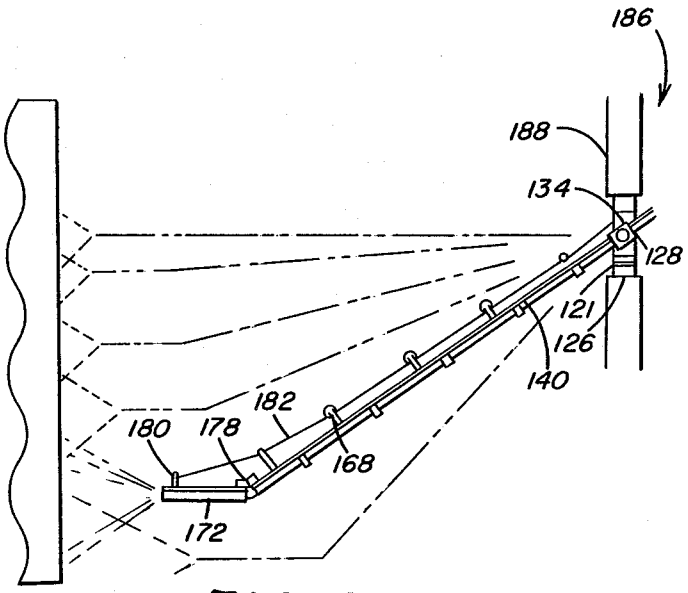
FIG. 8 is a schematic view of the supply pipe with a hingedly connected movable end portion attached to a boom swivel bracket which is in turn attached to a ladle or other vessel for receiving molten metal and showing in phantom various positions of the supply pipe.

Furnace 110 has an inner shell 116 formed of abutting steel plates. The furnace 110 has a refractory lining 118 which is susceptible to an erosion when the furnace is in operation over a long period of time. According to another preferred embodiment of this invention, circumferentially spaced windows 121, 122, 123 and 124 (only window 121 is shown in FIGS. 5 and 8) are provided to extend through furnace wall 111. The windows have sills 126 located approximately 10 (ten) feet above the mantle 112. Each sill 126 supports a pedestal 128.

A boom swivel bracket 130 is pivotally supported on each pedestal 128 by a furnace shell mounting clamp 132 which is conventionally mounted to the pedestal 128. The mounting of furnace shell mounting clamp 132 to the pedestal 128 enables the boom swivel bracket 130 to swivel relative to the pedestal 128 at about an angle of at least 45° to each side of the diameter of a horizontal circle formed at the horizontal plane across the blast furnace 110 that intersects sill 126.

Figure 7:
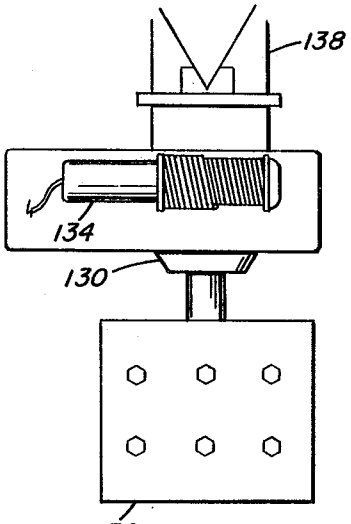
FIG. 7 is an enlarged, fragmentary vertical view of a boom swivel bracket with a nose tilt control winch connected to a pedestal.

As shown in FIG. 7, each boom swivel bracket 130 supports a nose tilt control winch 134 and an elongated angle iron 138. The elongated angle iron 138 is mounted on top of boom swivel bracket 130.

The elongated angle iron 138 supports an elongated pipe 140 throughout its entire length. The elongated angle iron 138 is provided with longitudinally spaced rings 141 through which the elongated pipe 140 extends to keep the elongated pipe aligned with the elongated angle iron.

Figure 3:
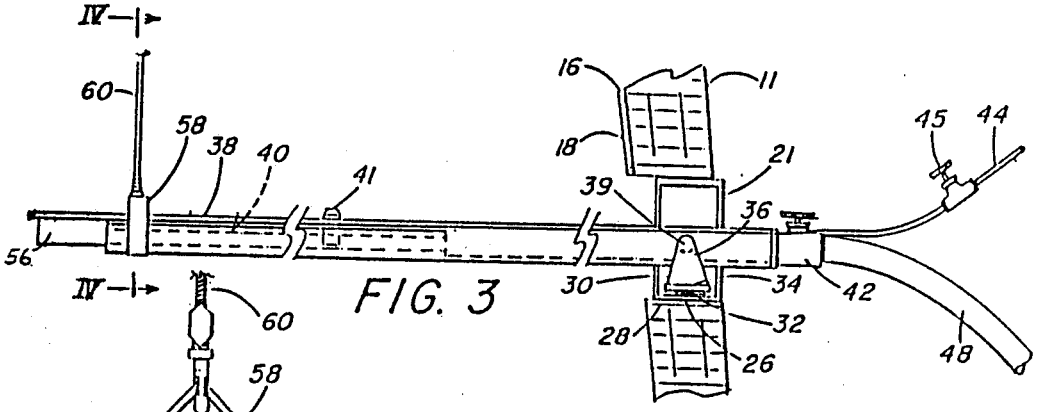
FIG. 3 is an enlarged, fragmentary vertical view of a supply pipe showing its manner of support and attachment to other supply lines.
Figure 4:
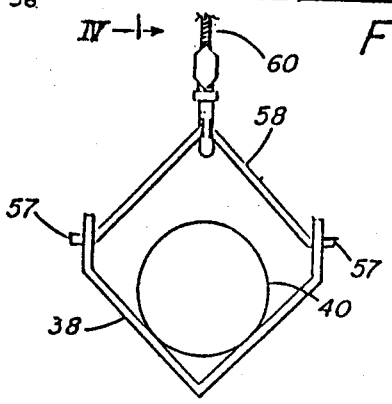
FIG. 4 is a view taken along a line IV—IV of FIG. 3.

When installed for operation in this embodiment of the invention, the elongated pipe 140 extends from its outer end a short distance outside one of the windows 121–124 of blast furnace 110 to its inner end facing interior surface 118 of shell 116 of furnace wall 111 diametrically opposite the window within which the pipe is inserted. A coupling, like that shown in FIG. 3, communicates with the outer end of pipe 140. A water supply line 144 supplies water under pressure into the outer end of the elongated pipe 140 from a pressurized water supply source 146. In addition, a granular refractory supply line 148 extending from a granular refractory source 150 to coupling point 151 is also provided. Furthermore, a pressurized air source 152 communicates with the granular refractory source 150 to an air supply line 154. In addition, a water supply line (not shown) is connected to the granular refractory source 150 for predampening granular refractory material.

An open-ended polygonal hook 158 suspended from the lower end of a steel cable 160 is supported by a bracket support 162 which in turn is secured to a winch support 164 mounted on the shell 116. The steel cable extends through an opening 165 is the furnace wall 111 approximately 16 feet above the level of sill 126 to a winch 164 supported externally of the blast furnace 110 in a manner such as that described in the other embodiment of the invention. Subject to the operation of the movable portion of the elongated pipe 140, the description and operation of the winch and the apparatus in general is as described in the embodiments of the present invention previously described.

Figure 6:
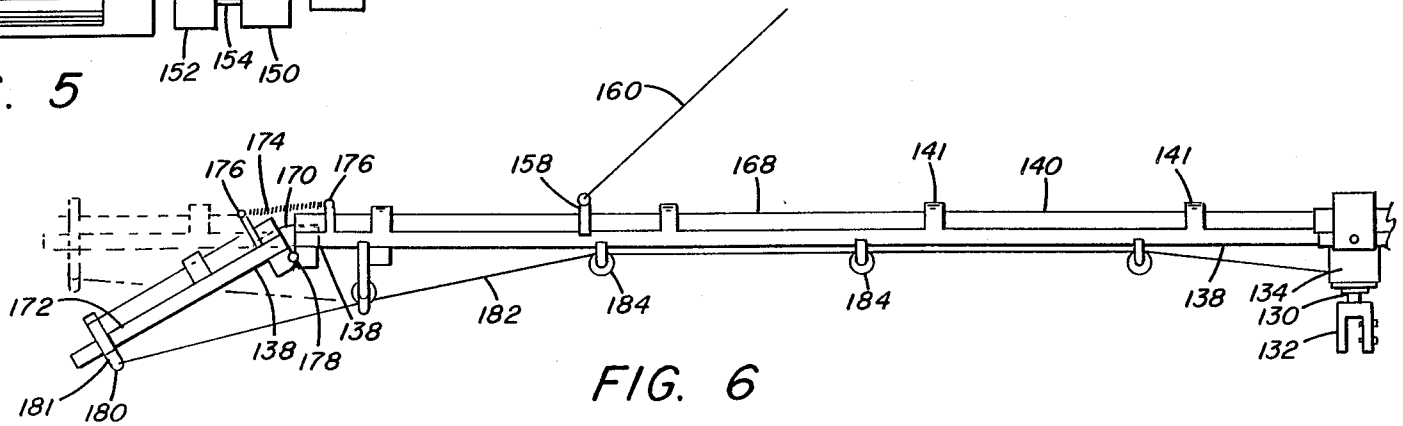
FIG. 6 is an enlarged, fragmentary vertical view of a supply pipe as shown in FIG. 5 showing a hingedly connected movable end portion.

Referring to FIG. 6, the elongated pipe has a rigid portion 168 which is connected to the furnace shell mounting clamp 132. A flexible segment 170 is secured to the elongated pipe 140 rigid portion 168 and to the nose portion 172 of elongated pipe 140. Nose draw springs 174 are connected to metallic saddles 176, which are attached to elongated angle iron 138 and maintain the flexible segment 170 and the nose portion 172 in a linear plane with the axis of the rigid pipe portion 168 aligned with the axis of the nose potion 172. The nose portion 172 is rigid and unlike the flexible segment 170, cannot be bent. Near the end of nose portion 172, the metallic saddles 176 are connected to a nose tilt hinge 178, which is affixed to elongated angle iron 130 to provide for movement of the flexible segment 170 and nose portion 172 relative to the rigid portion 168 of the elongated pipe 140.

A nose draw bar 180 is affixed to the end of nose portion 172 at point 181. The nose draw bar 180 has a nose control cable 182 which is guided by pulleys 184 affixed to elongated angle iron 138. The nose control cable 182 extends from the nose draw bar 180 to the nose tilt control winch 134.

Nose control winch 134 operates reversibly to extend and retract nose control cable 182 to cause flexible segment 170 and nose portion 172 to move upwardly or downwardly relative to rigid portion 168 of the elongated pipe 140. When nose tilt control winch 134 retracts nose control cable 182 it causes nose draw bar 180 to be raised or lowered and activates the hinging mechanism of nose tilt hinge 178 to raise or lower nose portion 172 of elongated pipe 140 relative to rigid portion 168. FIG. 5 shows elongated pipe 140 in a position where nose control cable 182 is in a retracted position and shows nose portion 172 bent downwardly relative to rigid portion 168.

In phantom, FIG. 6 shows nose control cable 182 in an extended position with nose portion 172 in a linear position with rigid portion 168 and nose tilt hinge 178 in a closed position.

In the embodiment of the invention shown in FIG. 8, elongated pipe 140 is mounted inversely to that previously described to the upper portion of a ladle 186 or like vessel for receiving molten metal. Nose control tilt winch 134 retracts nose control cable 182 to cause nose draw bar 180 to be raised. This activates the hinging mechanism of nose tilt hinge 178 to raise nose portion 172 of elongated pipe relative to rigid portion 168. FIG. 8 shows elongated pipe 140 in a position where nose control cable 182 is in a retracted position and nose portion 172 is bent upwardly relative to rigid portion 168.

FIG. 8, shows elongated pipe 140 with rigid portion 168 in approximately a 60° downward angle from pedestal 128 and nose portion 172 substantially perpendicular to the interior surface 188 of a ladle 186 or other like vessels for receiving molten metal. FIG. 8 shows in phantom various positions that elongated pipe 140 may be manipulated into. The rigid portion 168 and nose portion 172 may be linear relative to each other and substantially perpendicular to interior surface 188. The elongated pipe 140 may be manipulated to a 45° angle between rigid position 168 and pedestal 128. The elongated pipe 140 may be manipulated to achieve a 60° angle between rigid position 168 and nose portion 172.

This embodiment of the invention increases the surface area of the blast furnace 110, ladle 186 or like vessels having scale cleaned and replaced by refractory slurry. This embodiment of the invention further provides for the nose portion 172 of the elongated pipe 140 to be in a substantially perpendicular position to the interior surface 118 of a blast furnace 110 and the interior surface 188 of a ladle 186 or like vessels as illustrated in FIGS. 5 and 8, resulting in a greater impact of the cleaning material and of the refractory slurry material on the interior surface 118.

While a preferred embodiment shows four windows arranged at 90 degree spacing around the perimeter of the wall 11 of the blast furnace 10, with each window providing the source for application of materials to first clean and then recoat a different quadrant for each window, it is understood that fewer or more windows may be provided, depending upon the size and diameter of the blast furnace or other refractory lined vessel without departing from the gist of this invention.

While the described operation for relining a blast furnace or other refractory lined vessel involving a first spraying method of applying water to clean the interior surface of the blast furnace followed by a second spraying method of applying a new coating of the refractory materials onto the cleaned surface by applying a slurry of coating material, the principles of this invention are equally applicable to a spraying method to deposit any material suitable for treating an interior surface of a refractory lined vessel. Therefore, the present invention is not necessarily limited to the two method operation described, but may be employed in a method of spraying to either clean an eroded interior surface or to apply a coating of refractory material upon the interior surface of a refractory lined vessel.

According to the provisions of the Patent Statutes, the principle, preferred constructions and modes of operation of this invention have been explained and what is presently considered to represent its best embodiment has been illustrated and described. However, it should be understood that, within the scope of the claims that follow, this invention may be practiced otherwise than as specifically illustrated and described.

We claim:

1. Apparatus for relining the interior surface of a refractory lined vessel comprising, an elongated supply pipe extending into the interior of said vessel, said supply pipe being movably supported on a sill portion of said vessel, said supply pipe having an outlet end facing the interior surface of said vessel wall opposite said sill and an inlet end extending outside of said vessel, said supply pipe having a first rigid portion and a movable portion, said movable portion connected to said elongated supply pipe outlet end, means pivotally supporting said supply pipe on said sill portion to permit said supply pipe outlet end to pivot horizontally and vertically, means to supply material to be sprayed to said inlet end of said supply pipe, means to introduce air under pressure to said inlet end of said supply pipe to propel said material to be sprayed through said supply pipe and impinge on the interior surface of said vessel wall, means to control the supply of said material to be sprayed, means to control said flow of air under pressure, means to maintain the axis of said supply pipe movable portion aligned with the axis of said supply pipe rigid first portion, and means to pivotally raise and lower said outlet end of said supply pipe relative to the axis of said supply pipe rigid first portion.

2. Apparatus as set forth in claim 1, wherein said elongated supply pipe comprises, a rigid first portion of the supply pipe secured to said vessel by connecting means, a rigid end portion of the supply pipe connected to said rigid first portion of the supply pipe by a flexible segment, means to maintain said rigid end portion of said supply pipe axially aligned with said rigid end portion, and means to raise and lower said rigid end portion of said supply pipe relative to said rigid first portion of said supply pipe.

3. Apparatus as set forth in claim 2, wherein said rigid end portion of said supply pipe is in a substantially perpendicular position relative to said vessel wall.

4. Apparatus as set forth in claim 2 in which, said material supply means includes means to supply granular refractory material and water to the inlet end of said supply pipe, said means to supply ai under pressure arranged to entrain said granular material and water and discharge said granular material and water from the outlet end of said supply pipe.

5. Apparatus as set forth in claim 2 in which, said means to raise and lower said rigid end portion of the pipe includes a cable connecting the outer end of said rigid end portion to a tilt control switch, connecting means to secure said cable to the outer end of said rigid end portion, pulley means to guide said cable, a pedestal positioned on at least one of said sills, a bracket swivelly mounted on said pedestal for swiveling about a vertical axis relative to said pedestal, connecting means to connect said tilt control switch to said bracket, and means to swivel said bracket and pivot said outlet end of said supply pipe horizontally.

6. Apparatus as set forth in claim 5 in which said vessel is a blast furnace comprising, a mantle, a plurality of circumferentially spaced windows extending through said blast furnace wall at an elevation above said mantle, each of said windows having a sill, and said elongated supply pipe extending through one of said windows.

7. Apparatus as set forth in claim 6, wherein said rigid first portion of the supply pipe is movably raised and said rigid end portion of the supply pipe is lowered to position said rigid end portion of the supply pipe in a substantially perpendicular position relative to said blast furnace wall.

8. Apparatus as set forth in claim 6 which includes, an elongated member supporting said elongated supply pipe, said elongated member pivotally supported on said bracket for pivoting said supply pipe about a horizontal axis relative to said bracket, an overhead support extending into said blast furnace at an elevation above said window, connecting means connected to said overhead support and arranged to support said elongated member within said blast furnace, and means to raise and lower said connecting means to pivot said elongated member vertically and pivot said rigid end portion of said supply pipe vertically.

9. Apparatus as set forth in claim 8, wherein said overhead support includes, a connecting means, a winch supported outside said blast furnace, a pulley supported outside said blast furnace above said winch, an opening in said blast furnace wall between said overhead support and said pulley, said cable being attached at its other end to said winch and extending over said pulley through said opening, and said winch arranged through said cable to raise and lower said rigid end of said supply pipe.

10. Apparatus as set forth in claim 5, wherein said rigid first portion of the supply pipe is movably lowered and said rigid end portion of the supply pipe is raised to position said rigid end portion of said supply pipe in a substantially perpendicular position relative to said blast furnace wall.

11. A method of spraying material upon at least a portion of a wall of a refractory lined vessel, said method comprising, extending an elongated supply pipe having a rigid first portion movably connected to a rigid end portion into the interior of said vessel with said rigid end portion facing a part of said vessel interior opposite the point of extension, securing said rigid end portion of the supply pipe to said rigid first portion of the supply pipe by a flexible segment, movably supporting said supply pipe to an upper sill portion of said vessel, supplying material to be sprayed to a portion of said supply pipe from a location exterior to said vessel.

applying air under pressure to said rigid supply pipe to propel said material to be sprayed through said supply pipe and impinge on a first part of said vessel interior surface opposite said rigid end portion of said supply pipe, pivotally supporting said supply pipe relative to said sill to allow said supply pipe to pivot about two angularly related axes normal to the lengths of said supply pipe, pivoting said supply pipe about at least one of said angularly related axes while continuing said supplying and applying steps to propel said material onto different portions of said vessel interior adjacent to said rigid first portion, and raising or lowering said rigid end portion of the supply pipe relative to said rigid first portion of the supply pipe to position said rigid end portion in a substantially perpendicular position relative to said vessel interior part to be sprayed.

* * * * *